US012207727B1

(12) United States Patent
Jiang

(10) Patent No.: US 12,207,727 B1
(45) Date of Patent: Jan. 28, 2025

(54) RECIPROCATING CLEANING BRUSH

(71) Applicant: Yong Jiang, Guangzhou (CN)

(72) Inventor: Yong Jiang, Guangzhou (CN)

( * ) Notice: Subject to any disclaimer, the term of this patent is extended or adjusted under 35 U.S.C. 154(b) by 0 days.

(21) Appl. No.: 18/809,342

(22) Filed: Aug. 20, 2024

(51) Int. Cl.
*A46B 13/02* (2006.01)

(52) U.S. Cl.
CPC ..... *A46B 13/02* (2013.01); *A46B 2200/30* (2013.01)

(58) Field of Classification Search
CPC ..... A46B 13/02; A46B 2200/30
USPC ..... 15/22.1
See application file for complete search history.

(56) References Cited

U.S. PATENT DOCUMENTS 1,080,390 A * 12/1913 Vandal ..... A46B 13/02 15/21.1
3,517,235 A * 6/1970 Siegfried ..... A46B 13/02 310/90
4,005,502 A * 2/1977 Stevens (Boyer) ..... A47L 11/4005 15/22.1
4,027,348 A * 6/1977 Flowers ..... A46B 13/02 601/114
5,165,132 A * 11/1992 Giorgio ..... A46B 13/06 451/356
11,266,285 B2 3/2022 Pruiett et al.
11,548,176 B2 * 1/2023 Krauss ..... B26B 19/3813
2005/0177962 A1 * 8/2005 Chan ..... A61C 17/3436 15/22.1
2005/0199265 A1 * 9/2005 France ..... A61C 17/34 15/97.1
2006/0179590 A1 * 8/2006 Spooner ..... A46B 7/04 15/22.2
2015/0132041 A1 * 5/2015 Muraki ..... B01F 33/5011 401/4
2016/0045081 A1 * 2/2016 Kern ..... A46B 13/008 15/22.4
2017/0273514 A1 * 9/2017 Hung ..... A47K 7/02
2022/0010866 A1 * 1/2022 Bernardi ..... B24B 23/03

FOREIGN PATENT DOCUMENTS

AT 10255 U1 * 12/2008
CN 105996869 A * 10/2016 ..... A46B 13/02
CN 107411619 A * 12/2017 ..... A46B 13/02
CN 107440584 A * 12/2017 ..... A46B 13/02
CN 209531654 U * 10/2019
CN 111166047 B * 7/2021 ..... A46B 13/02
CN 113520034 A * 10/2021
CN 214318202 U * 10/2021

(Continued)

*Primary Examiner* — Marc Carlson
(74) *Attorney, Agent, or Firm* — Ying-Ting Chen; Law Office of Michael Chen

(57) ABSTRACT

A reciprocating cleaning brush includes a support housing wherein the top of the support housing is fixedly connected to a fixed top housing, the inside of the fixed top housing is fixedly connected to a first housing, the front and rear ends of the first housing are respectively slidably connected to metal connecting rods, a first slider located below the first housing is fixedly connected between the two metal connecting rods, one end of the first slider is fixedly connected to a second rivet, a reciprocating push rod is rotatably connected to the second rivet, a motor is fixedly connected inside the fixed top housing, a reduction box is connected to the rotating shaft of the motor, and an eccentric wheel is fixedly connected to the top of the reduction box.

5 Claims, 9 Drawing Sheets

(56) References Cited

FOREIGN PATENT DOCUMENTS

| | | | | | |
|---|---|---|---|---|---|
| CN | 215650768 | U | * | 1/2022 | |
| CN | 215739595 | U | * | 2/2022 | |
| CN | 218185730 | U | * | 1/2023 | |
| CN | 218185739 | U | * | 1/2023 | |
| CN | 220001119 | U | * | 11/2023 | |
| CN | 117243459 | A | * | 12/2023 | |
| CN | 117297815 | A | * | 12/2023 | |
| CN | 220494497 | U | * | 2/2024 | |
| GB | 2472064 | A | * | 1/2011 | ..... A46B 13/02 |
| JP | 3460262 | B2 | * | 10/2003 | |
| JP | 2017070483 | A | * | 4/2017 | ..... A46B 13/008 |
| KR | 20070052117 | A | * | 5/2007 | |
| KR | 20090006512 | U | * | 7/2009 | |
| KR | 101608219 | B1 | * | 4/2016 | |
| KR | 102207934 | B1 | * | 1/2021 | |
| TW | 202143922 | A | * | 12/2021 | |
| WO | WO-2004024025 | A1 | * | 3/2004 | ..... A46B 9/028 |
| WO | WO-2004064572 | A2 | * | 8/2004 | ..... A47L 13/10 |
| WO | WO-2015119381 | A1 | * | 8/2015 | ..... A46B 13/02 |

* cited by examiner

RECIPROCATING CLEANING BRUSH

FIELD OF THE INVENTION

The invention relates to the technical field of brushes, in particular to a reciprocating cleaning brush.

BACKGROUND OF THE INVENTION

Brush, also known as hair brush, generally refers to a tool made of hair, palm, plastic wire, metal wire, etc. for removing dirt. Brushes are generally long or elliptical in shape, some of them are provided with handles. They can be divided into industrial brushes and civilian brushes according to their application fields.

The brush head of the existing cleaning brush is fixed, so that when cleaning, the user needs to hold the brush body and perform a back and forth cleaning operation on a designated position, which is time-consuming and laborious, and cannot improve the cleaning efficiency.

Therefore, the present invention provides a reciprocating cleaning brush to solve the above problems.

SUMMARY OF THE DISCLOSURE

In view of the above situation, in order to overcome the shortcomings of the prior arts, the present invention provides a reciprocating cleaning brush, which effectively solves the problem that the existing cleaning brush is time-consuming and labor-intensive, and the cleaning efficiency needs to be improved.

To achieve the above object, the present invention provides the following technical solutions:

A reciprocating cleaning brush includes a support housing, the top of the support housing is fixedly connected to a fixed top housing, the inside of the fixed top housing is fixedly connected to a first housing, the front and rear ends of the first housing are respectively slidably connected to metal connecting rods, a first slider located below the first housing is fixedly connected between the two metal connecting rods, one end of the first slider is fixedly connected to a second rivet, a reciprocating push rod is rotatably connected to the second rivet, a motor is fixedly connected inside the fixed top housing, a reduction gear is connected to the rotating shaft of the motor, an eccentric wheel is fixedly connected to the top of the reduction box, a first rivet is fixedly connected to one side of the top of the eccentric wheel, the other end of the reciprocating push rod is rotatably connected to the first rivet, a second slider located above the first housing is fixedly connected between the two metal connecting rods, and a cleaning brush is provided on the second slider.

Preferably, the top of the fixed top housing is fixedly connected to the second housing, the second slider is located below the second housing, the top of the second slider is fixedly connected to the third housing, and the cleaning brush is installed on the third housing.

Preferably, an inclined handle is fixedly connected to the support housing, a control main board is fixedly connected inside the handle, an on/off switch and a speed adjustment touch key are provided on the upper and lower sides of the control main board, and a battery is provided inside the handle.

Preferably, the second slider is fixedly connected to an elastic block located at the left of the third housing, an insert opening is provided at the left end of the third housing, and an insert block is fixedly connected to the bottom of the left side of the cleaning brush.

Preferably, a tail rod is provided at the end of the handle, and a power indicator light is provided at the bottom of the support housing.

Compared with the prior art, the present invention has the following beneficial effects:

1. Through the coordinated action of components, the corresponding target can be cleaned by the left and right sliding of the cleaning brush, which reduces the physical force exerted by personnel and improves convenience.
2. The speed adjustment touch key can adjust the speed of the motor through the reduction box, so that the cleaning brush work at a variety of speeds. The handheld electric reciprocating cleaning structure makes cleaning more efficient and convenient.

DETAILED DESCRIPTION OF THE PREFERRED EMBODIMENTS

Figure 1:
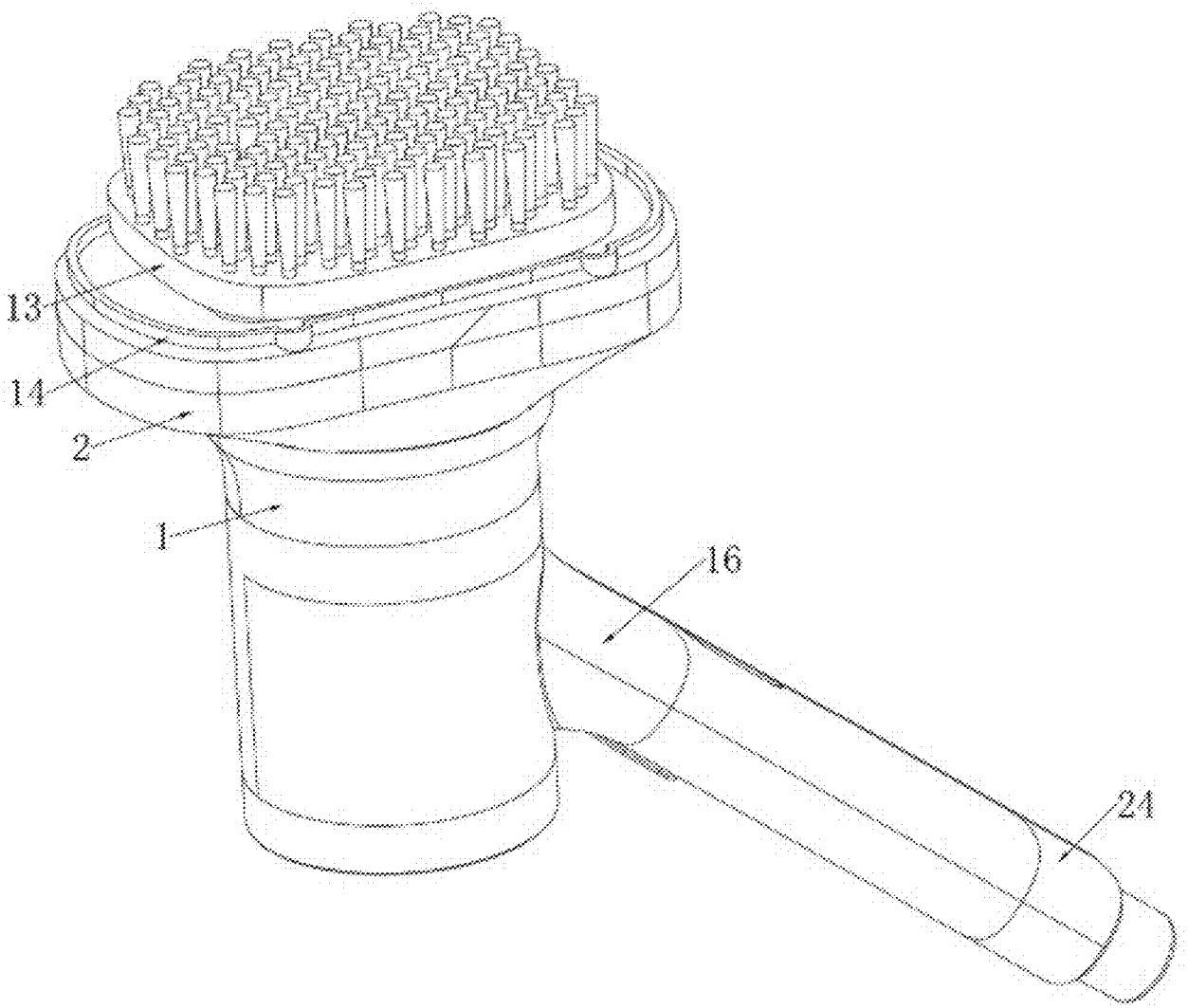
FIG. 1 is a perspective view of the present invention.

Other features, objects and advantages of the present invention will be more clearly and completely by the detailed description of the non-limiting embodiments with reference to the attached drawings (FIG. 1 to FIG. 9). Obviously, the described embodiments are only part of the embodiments of the present invention, but not all of them. Based on the embodiments of the present invention, all other embodiments obtained by ordinary technicians in the field without creative labor are within the scope of the present invention.

A reciprocating cleaning brush, as shown in FIGS. 1 to 5, includes a support housing 1, the top of the support housing 1 is fixedly connected to a fixed top housing 2, the interior of the fixed top housing 2 is connected to a first housing 3 by screws, the front and rear bottom ends of the first housing 3 are respectively slidably connected to metal connecting rods 4, a first slider 5 is fixedly connected between the two metal connecting rods 4, the top surface of the first slider 5 slides left and right along the bottom surface of the first housing 3, a second rivet 6 is fixedly connected to the right of the first slider 5, a reciprocating push rod 7 is rotatably connected to the second rivet 6, the reciprocating push rod 7 is arranged below the first slider 5, a motor 8 is fixedly connected to the interior of the fixed top housing 2, a reduction box 9 is connected to the rotating shaft of the motor 8, and the top of the reduction box 9 is fixedly connected to the fixed top housing 2. The reduction box 9 could be provided as an existing device. The top of the reduction box 9 is coaxially fixedly connected to an eccentric wheel 10, a first rivet 11 is fixedly connected to one side of the top of the eccentric wheel 10, the first rivet 11 is far away from the center side of the eccentric wheel 10, the other end of the reciprocating push rod 7 is rotatably connected to the first rivet 11, the reciprocating push rod 7 is arranged above the eccentric wheel 10, a second slider 12 is fixedly connected between the two metal connecting rods 4, the second slider 12 is provided above the first housing 3, the first housing 3 will not affect the left and right sliding of the second slider 12 and the metal connecting rod 4, and a cleaning brush 13 is provided on the second slider 12.

Figure 3:
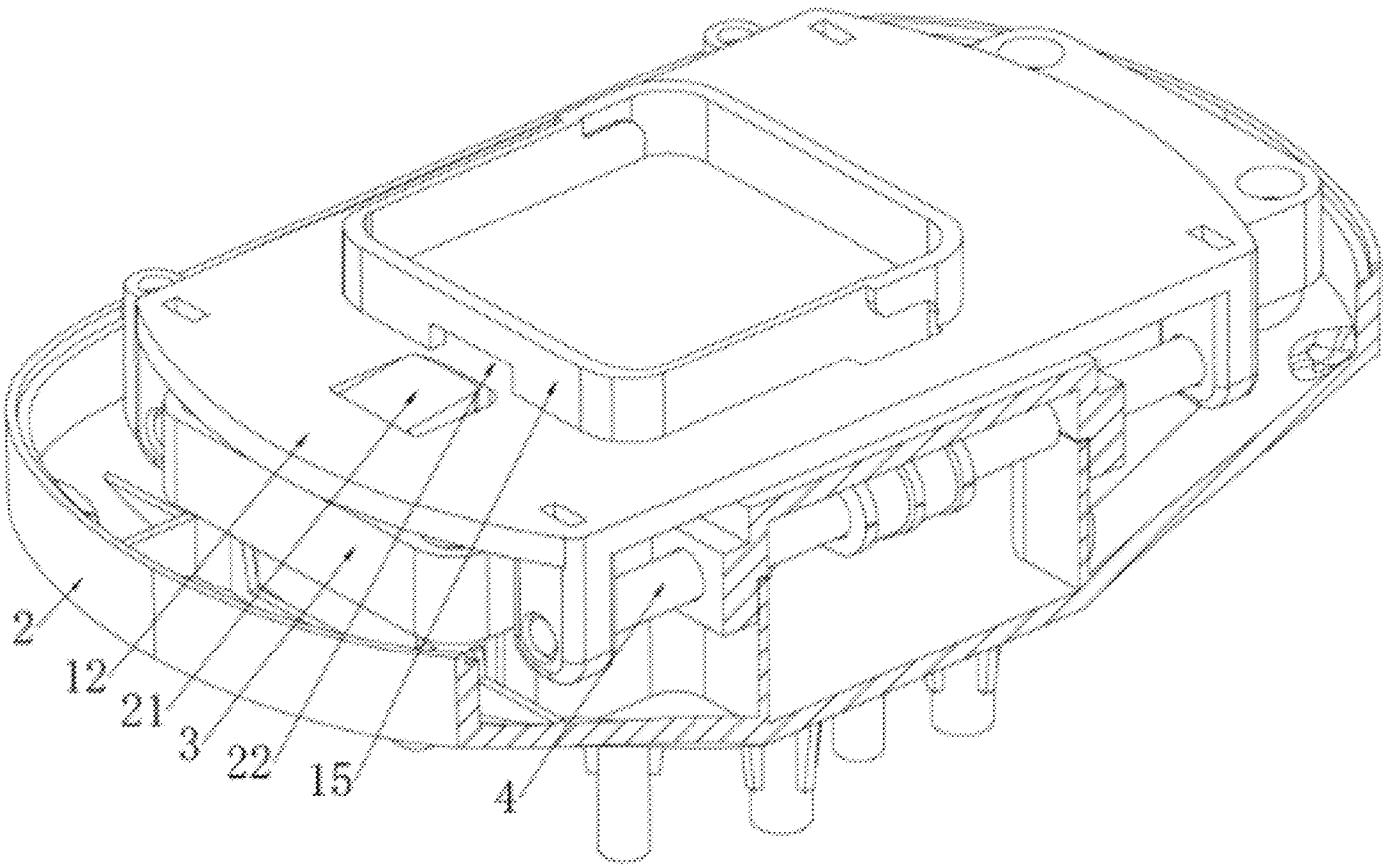
FIG. 3 is a schematic view of the installation position of the second slider of the present invention.
Figure 4:
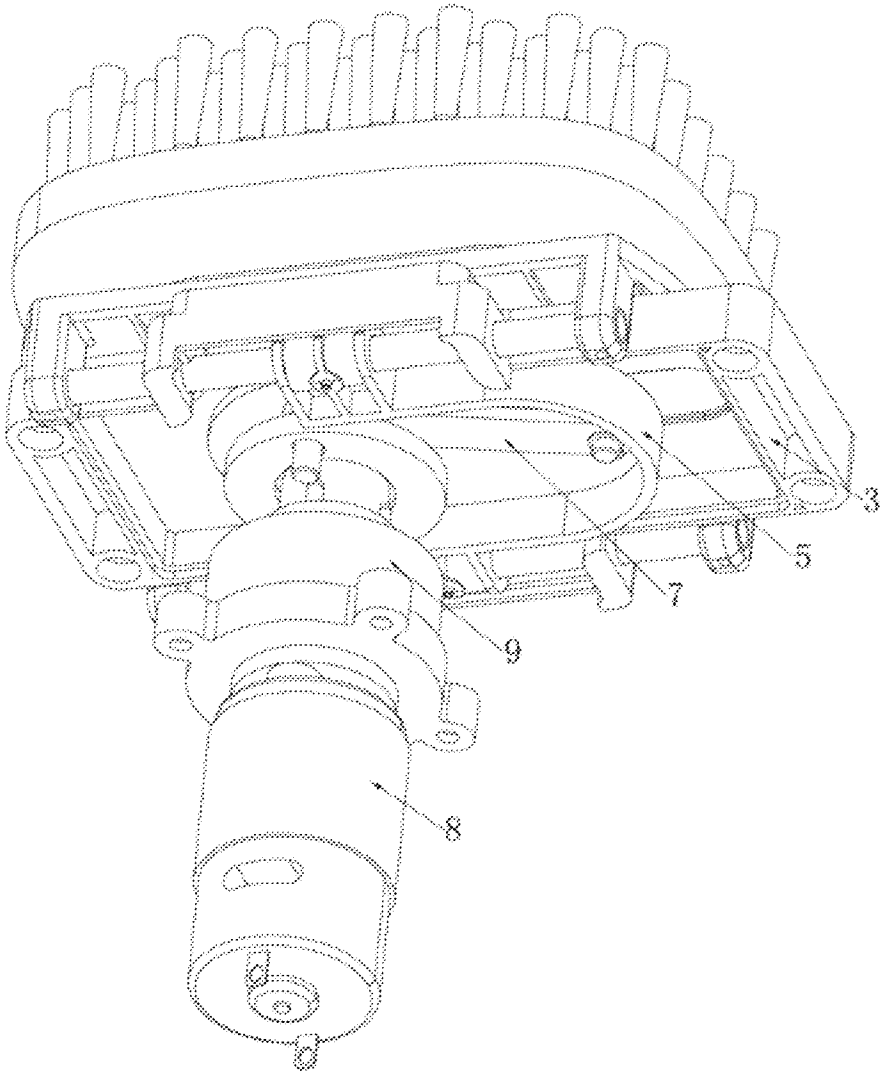
FIG. 4 is a schematic view of the installation position of the first slider of the present invention.
Figure 5:
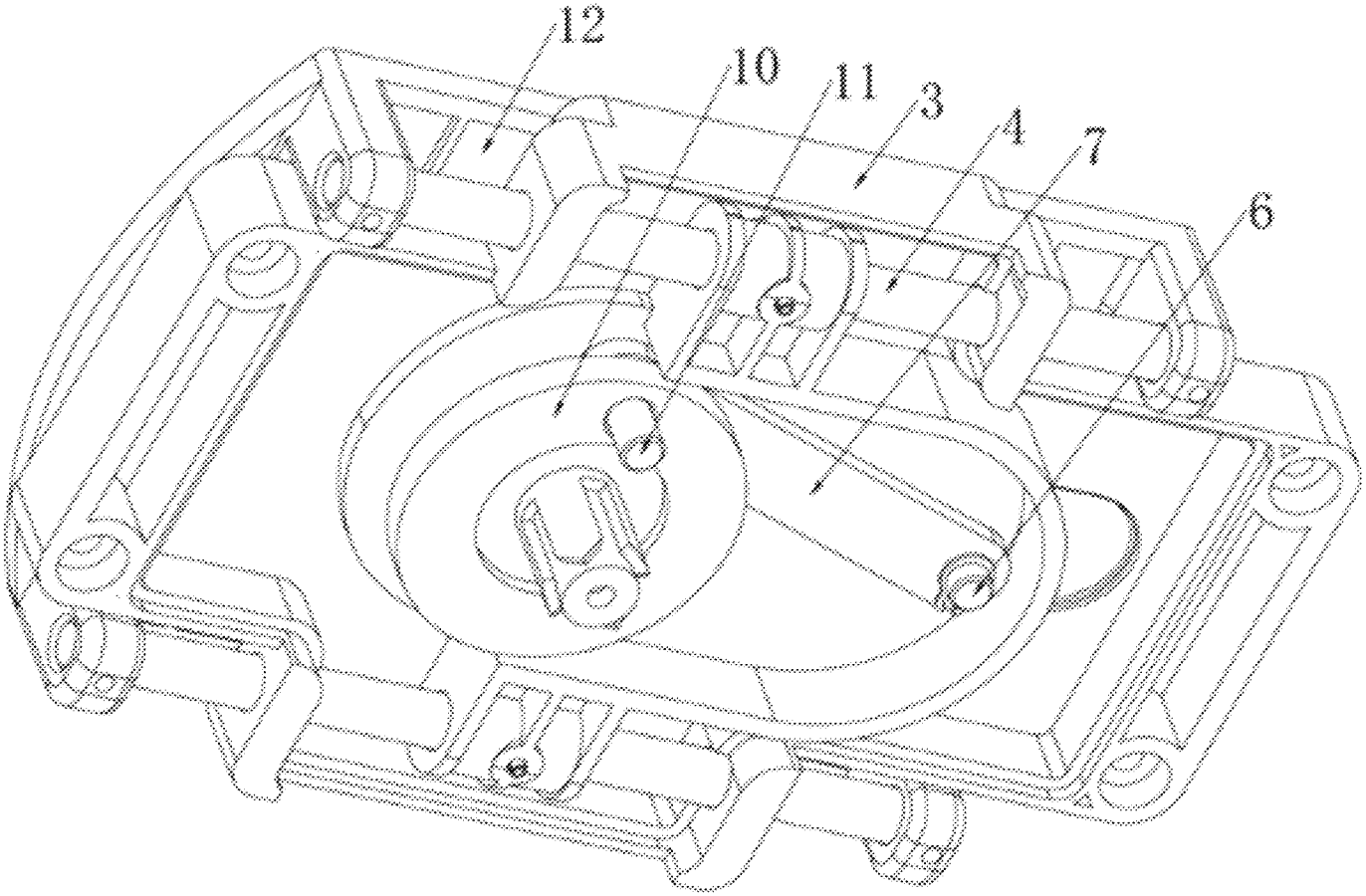
FIG. 5 is a schematic view of the metal connecting rod structure of the present invention.
Figure 6:
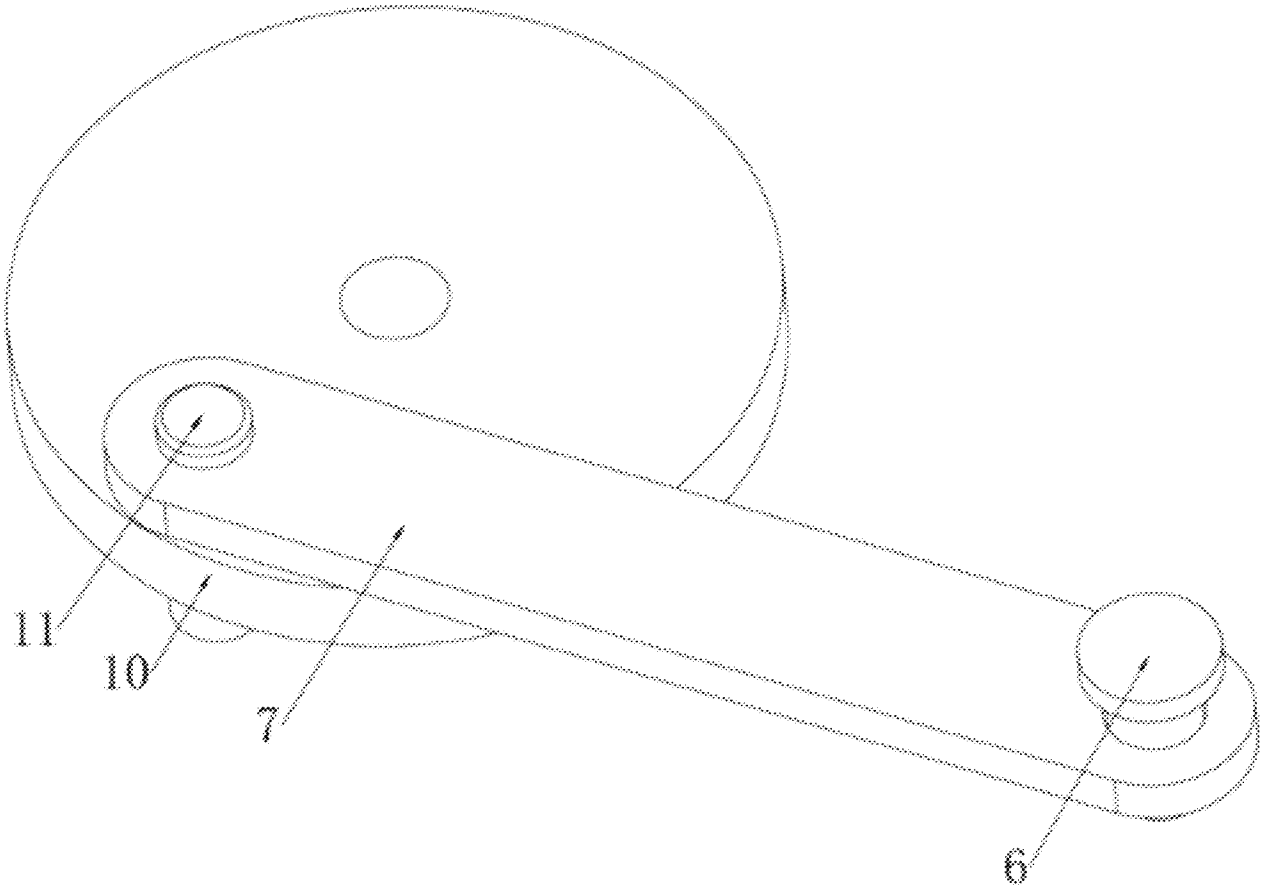
FIG. 6 is a schematic view of the structure of the reciprocating push rod and the eccentric wheel of the present invention.

As shown in FIGS. 1 and 3, the top of the fixed top housing 2 is fixedly connected to the second housing 14, the second slider 12 slides left and right under the second housing 14, the middle of the second housing 14 is provided with a sliding opening, the top of the second slider 12 is fixedly connected to the third housing 15 located in the sliding opening, the third housing 15 is slidably connected to the inside of the sliding opening, and the cleaning brush 13 is installed on the third housing 15.

Figure 2:
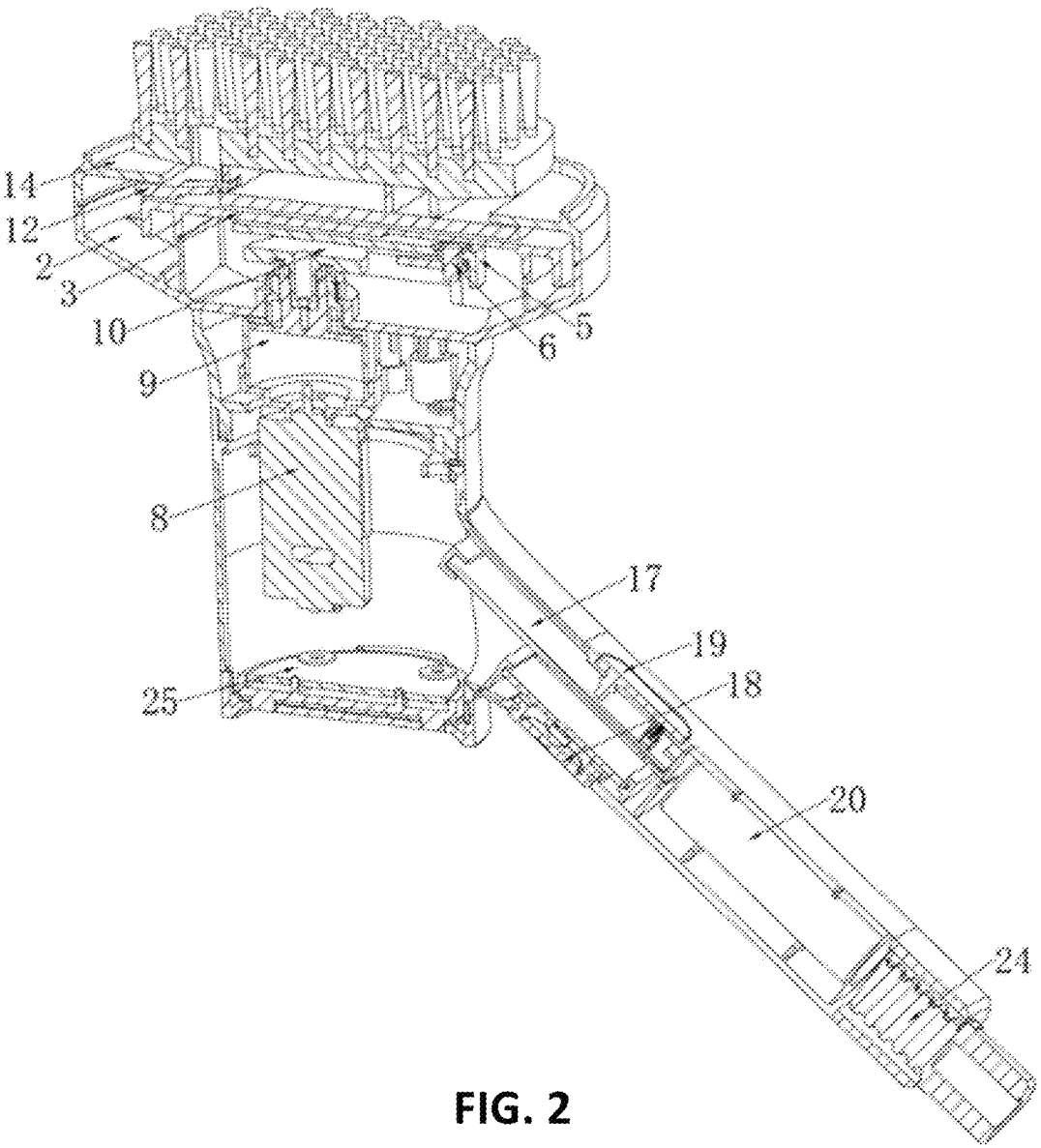
FIG. 2 is a cross-sectional schematic view of FIG. 1 of the present invention.

As shown in FIG. 2, an inclined handle 16 is fixedly connected to the support housing 1, the interior of the handle 16 is provided as cavity structure, a control main board 17 is fixedly connected inside the handle 16, the outer end of the handle 16 is provided with an on/off switch 18 and a speed adjustment touch key 19 located on the upper and lower sides of the control main board 17, a battery 20 is provided inside the handle 16, the motor 8 and the reduction box 9 are connected to the control main board 17 through wires, the control main board 17 is connected to the battery 20 through wires, and the on/off switch 18 and the speed adjustment touch key 19 are connected to the control main board 17 through wires.

Figure 7:
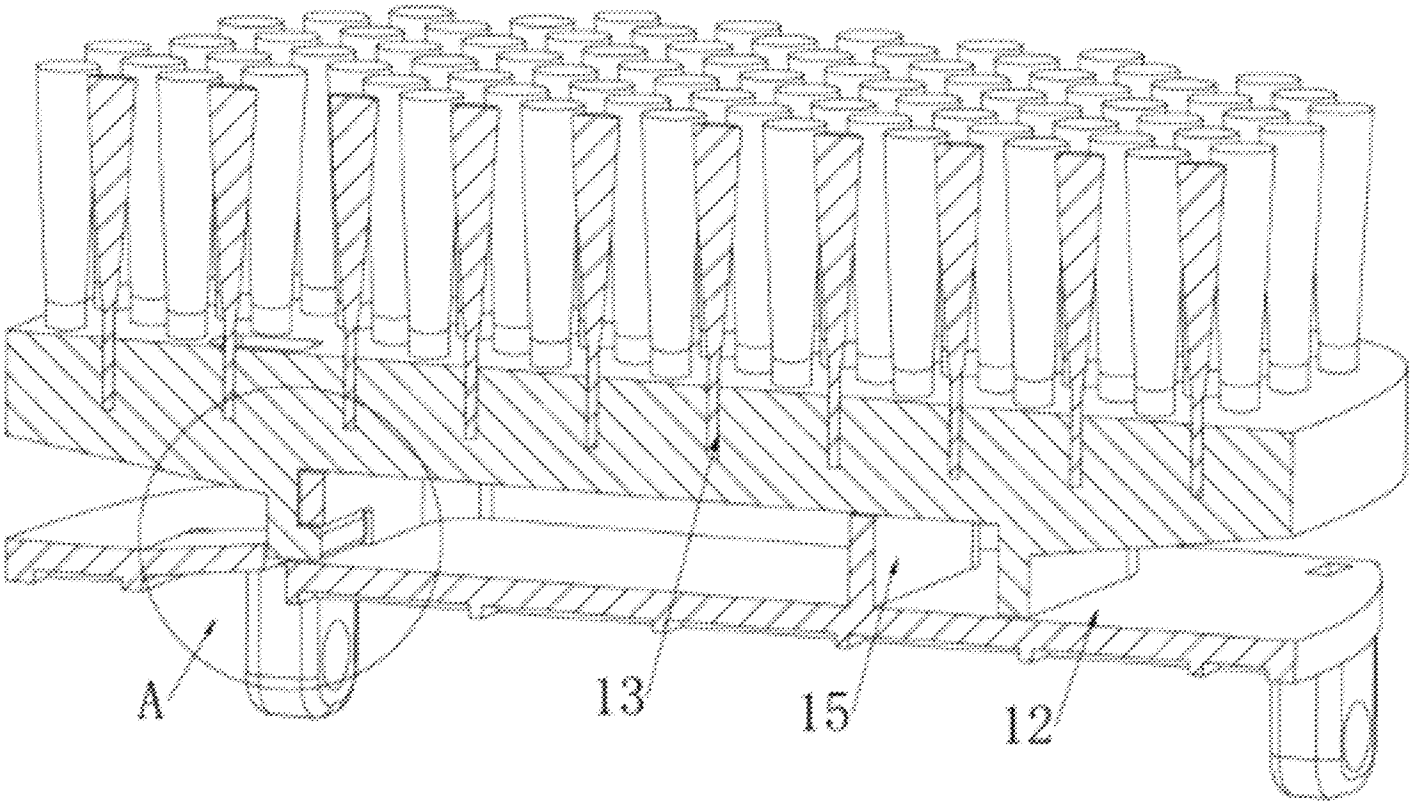
FIG. 7 is a cross-sectional perspective view of the present invention.
Figure 8:
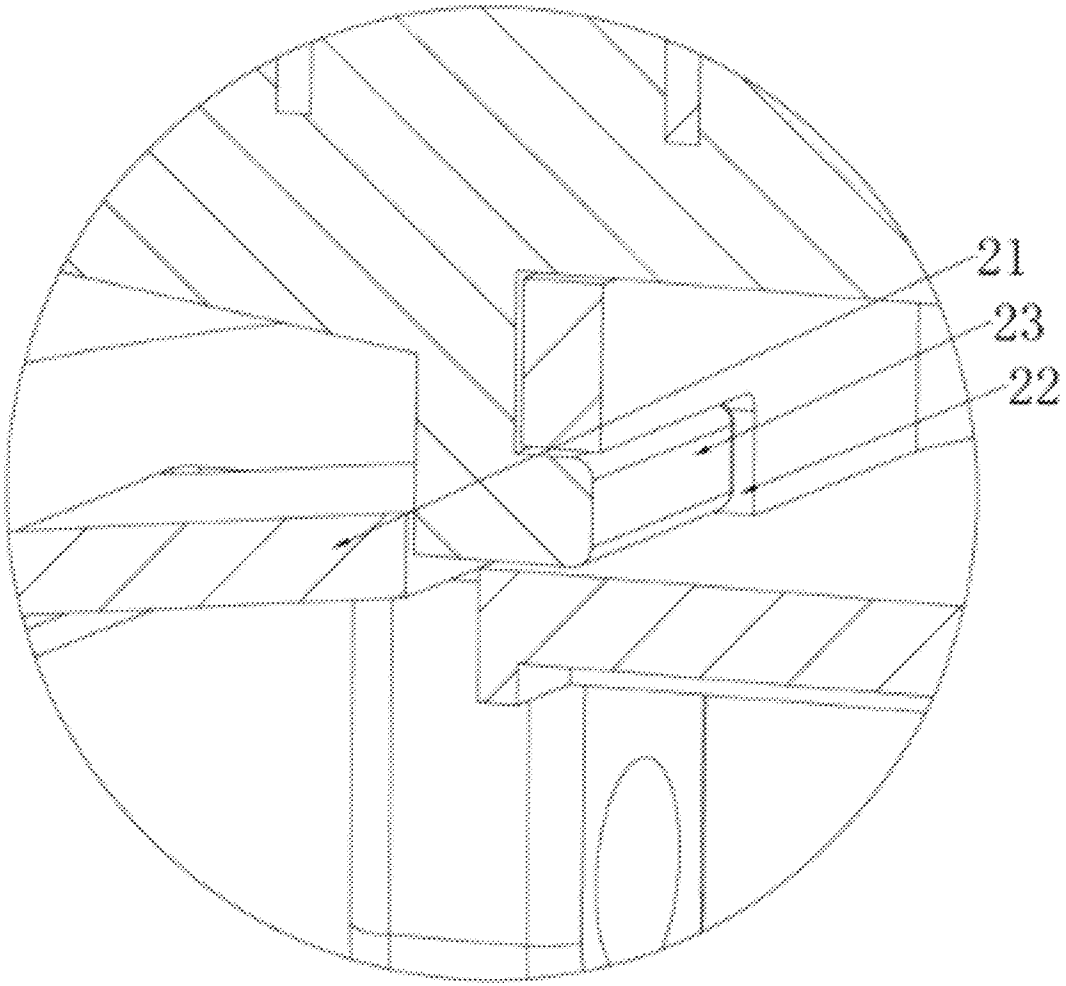
FIG. 8 is an enlarged schematic view of point A in FIG. 7 of the present invention.
Figure 9:
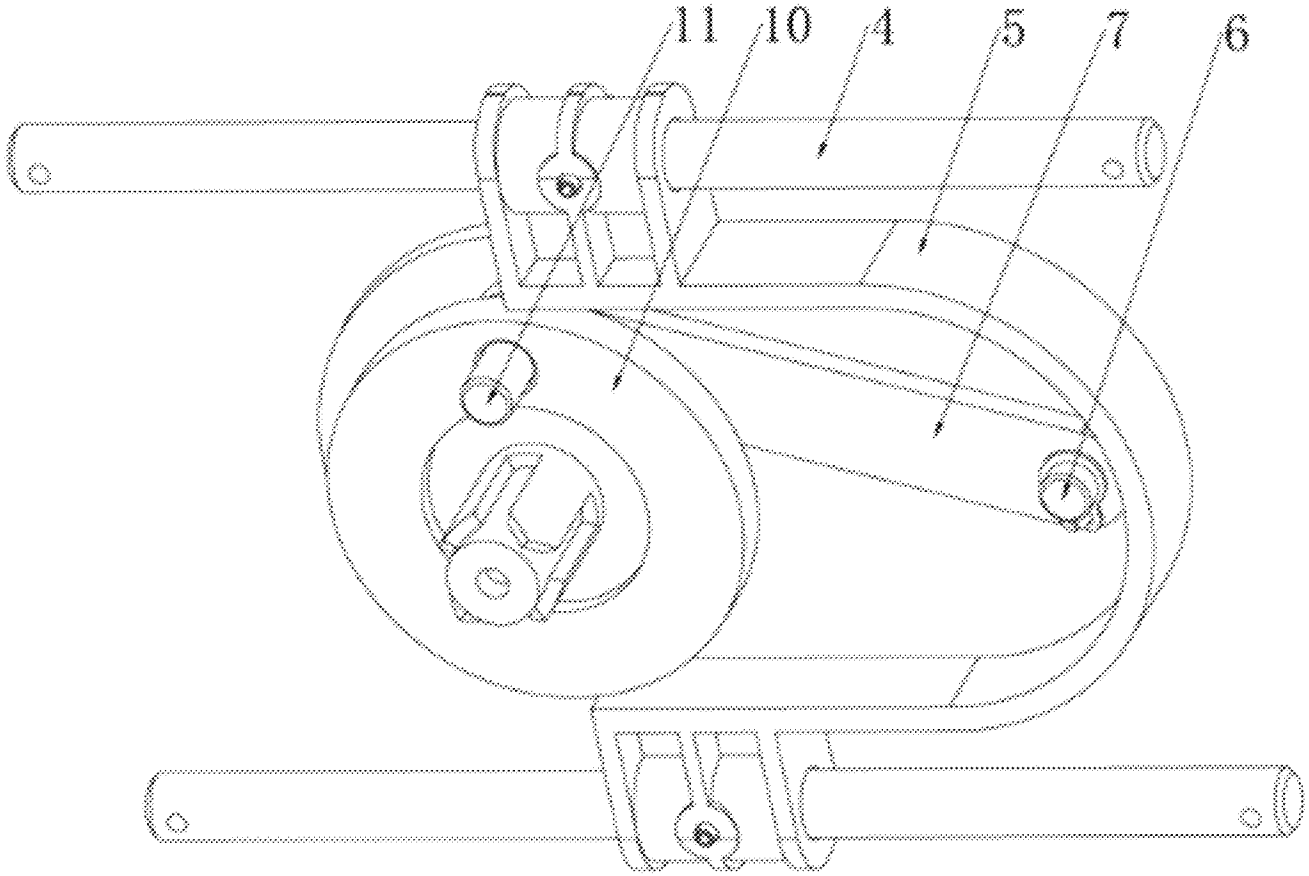
FIG. 9 is a schematic view of the installation position of the first rivet of the present invention.

As shown in FIGS. 2, 7 and 8, the second slider 12 is fixedly connected to an elastic block 21 located at the left of the third housing 15, the elastic block 21 is provided as tilted, the left end of the third housing 15 is provided with an insert opening 22, and the bottom of the cleaning brush 13 is fixedly connected to the housing. The length between the left and right sides of the housing is larger than the length between the left and right sides of the third housing 15, and an insert block 23 is fixedly connected to the bottom of the left side of the housing.

When in use, the elastic block 21 is pressed down, the housing is moved downward on the outer surface of the third housing 15, and the insert block 23 slides along the outer surface of the third housing 15. When the insert block 23 is inserted into the inset opening 22, the elastic block 21 is released, and the elastic block 21 rebounds upward and presses against the outer surface of the housing to achieve squeezing and fixing of the housing.

As shown in FIG. 2, a tail rod 24 is threadedly connected to the bottom of the handle 16, and a power indicator light 25 is provided at the bottom of the support housing 1, and the power indicator light 25 is connected to the control main board 17 through wires.

The working principle of the present invention:

When it is necessary to clean the corresponding target, the personnel hold the handle 16 and the tail rod 24, make the bristles of the cleaning brush 13 contact the corresponding target, then press the on/off switch 18, the motor 8 and the reduction box 9 are powered by the control main board 17 and the battery 20, the motor 8 drives the reduction box 9 to rotate, and the reduction box 9 drives the eccentric wheel 10 to rotate. Since the first rivet 11 is provided on one side of the center of the eccentric wheel 10, the eccentric wheel 10 drives one end of the reciprocating push rod 7 to rotate, at the same time, the other end of the reciprocating push rod 7 drives the second rivet 6 and the first slider 5 for reciprocating sliding toward left and right, and the two metal connecting rods 4 drive the second slider 12 and the cleaning brush 13 to slide left and right. During the left and right sliding process of the cleaning brush 13, the corresponding targets are cleaned. Since the second slider 12 drives the cleaning brush 13 to reciprocate, the cleaning brush 13 is more stable when reciprocating, which reduces the physical force exerted by personnel and improves the convenience of the cleaning brush 13.

The speed adjustment touch key 19 can adjust the speed of the motor 8 through the reduction box 9, so that the cleaning brush 13 can work at various speeds. In addition, the power indicator light 25 can be used to observe the power level. The handheld electric reciprocating cleaning structure makes cleaning more efficient and convenient, thereby improving the working efficiency of the cleaning brush 13.

In the present invention, the use of orientation words such as "top", "bottom", "left", "right" are only for the convenience of description, rather than indicating or implying the specific orientation, therefore it should not be construed as being limited to the description of the following embodiments. In addition, it should be noted that the terms "first", "second", "third" and the like in the description and claims of the present invention and the above drawings are used to distinguish similar objects, which are not necessarily used to describe the specific order or sequence. It is to be understood that the data so used are interchangeable under appropriate circumstances in order to describe the embodiments of the invention herein.

Unless otherwise stated, it should be noted that the terms "installed" and "connected" should be understood broadly. For example, "connected" could be fixed connection, detachable connection, integral connection, mechanical connection, electrical connection, direct connection, indirect connection through the intermediate structure, or internal connection between two elements. For those of ordinary skill in this field, the specific meanings of the above terms in the present invention can be understood in specific situations.

Hereinafter, embodiments of the present invention have been described in detail with reference to the accompanying drawings. While the description above refers to the particular embodiments of the present invention, it will be understood that many modifications may be made without departing from the spirit thereof. Any equivalent replacement or modification would fall within the protection scope of the present invention.

What is claimed is:

1. A reciprocating cleaning brush, including a support housing (1), wherein a top of the support housing (1) is fixedly connected to a fixed top housing (2), the inside of the fixed top housing (2) is fixedly connected to a first housing (3), the front and rear ends of the first housing (3) are respectively slidably connected to metal connecting rods (4), a first slider (5) located below the first housing (3) is fixedly connected between the two metal connecting rods (4), one end of the first slider (5) is fixedly connected to a second rivet (6), a reciprocating push rod (7) is rotatably connected to the second rivet (6), a motor (8) is fixedly connected inside the fixed top housing (2), a reduction box (9) is connected to the rotating shaft of the motor (8), an eccentric wheel (10) is fixedly connected to the top of the reduction box (9), a first rivet (11) is fixedly connected to one side of the top of the eccentric wheel (10), the other end of the reciprocating push rod (7) is rotatably connected to the first rivet (11), a second slider (12) located above the first housing (3) is fixedly connected between the two metal connecting rods (4), and a cleaning brush (13) is provided on the second slider (12).

2. A reciprocating cleaning brush according to claim 1, wherein the top of the fixed top housing (2) is fixedly connected to a second housing (14), the second slider (12) is located below the second housing (14), the top of the second slider (12) is fixedly connected to the third housing (15), and the cleaning brush (13) is installed on the third housing (15).

3. A reciprocating cleaning brush according to claim 1, wherein an inclined handle (16) is fixedly connected to the support housing (1), a control main board (17) is fixedly connected inside the handle (16), an on/off switch (18) and a speed adjustment touch key (19) are provided on the upper and lower sides of the control main board (17), and a battery (20) is provided inside the handle (16).

4. A reciprocating cleaning brush according to claim 2, wherein the second slider (12) is fixedly connected to an elastic block (21) located at the left of the third housing (15), an insert opening (22) is respectively provided at the left end of the third housing (15), and an insert block (23) is fixedly connected to the bottom of the left side of the cleaning brush (13).

5. A reciprocating cleaning brush according to claim 1, wherein a tail rod (24) is provided at the end of the handle (16), and a power indicator light (25) is provided at the bottom of the support housing (1).

* * * * *